United States Patent [19]

Schnurrenberger

[11] 4,118,050

[45] Oct. 3, 1978

[54] SKI HAVING A THREE-DIMENSIONAL RUNNING SURFACE

[75] Inventor: Hermann Schnurrenberger, Straubing, Germany

[73] Assignee: Franz Völkl oHG, Strubing, Germany

[21] Appl. No.: 776,682

[22] Filed: Mar. 11, 1977

[30] Foreign Application Priority Data

Mar. 12, 1976 [DE] Fed. Rep. of Germany ..... 2610522
May 4, 1976 [DE] Fed. Rep. of Germany ..... 2621490

[51] Int. Cl.[2] ..... A63C 5/04
[52] U.S. Cl. ..... 280/604; 280/610
[58] Field of Search ..... 280/604, 608, 609

[56] References Cited

U.S. PATENT DOCUMENTS 2,142,459 1/1939 Saky ..... 280/604
3,858,894 1/1975 Ver et al. ..... 280/604

FOREIGN PATENT DOCUMENTS 808,359 7/1936 France ..... 280/604
579,932 9/1976 Switzerland ..... 280/604

*Primary Examiner*—Richard A. Bertsch
*Assistant Examiner*—Gene A. Church
*Attorney, Agent, or Firm*—Gilbert L. Wells; Heinrich W. Herzfeld

[57] ABSTRACT

A ski is described which has a running surface and a profiling transverse to the longitudinal axis of the ski in at least one region of the underside of the ski intermediate the tip and the rear end of the latter. The ski comprises a rifling of grooves extending transversely to the longitudinal axis of the ski, in the aforesaid region of the underside of the ski, which rifling constitutes at least part of the transverse profiling. Preferably, the portions of the ski underside adjacent the rifled region and up to the tip of the ski, on the one hand, and up to the rear end of the ski, on the other hand, are smooth. Methods for producing the ski are also described.

22 Claims, 10 Drawing Figures

SKI HAVING A THREE-DIMENSIONAL RUNNING SURFACE

BACKGROUND OF THE INVENTION

This invention relates to a ski with a bottom surface of synthetic plastic resin material having good sliding properties, which preferably consists of an appropriate polyethylene customary for bottom surfaces of skis and has, as an aid to climbing, a transverse profiling in the middle region of the length of the ski. "Transverse profiling" here denotes a non-planar design in which projections or recesses do not exclusively extend in the longitudinal direction of the ski but transversely, that is to say obliquely or at right angle to the longitudinal direction of the ski. The running surface of the bottom of skis of this type is normally smoothed, outside the transversely profiled region, by grinding in the longitudinal direction of the ski, using a sufficiently fine polishing material, so that the frictional resistance on these smoothed parts is as low as possible.

Hitherto, an optimum compromise between the sliding properties of the ski and its climbing properties could only be achieved by appropriate waxing of the surface. However, this is relatively expensive. Skis having aids to climbing in the form of transverse profilings are therefore increasingly used as cross-country skis - certainly when not participating in races. Above all, positively projecting scales, scales which have been negatively recessed from the synthetic plastics bottom surface or strips of skin are used for this purpose. Skis of this type are known, for example, from German Patent Specifications 273,954 and 1,059,327 or from German Offenlegungsschriften 1,678,261 and 1,954,075. Admittedly, these known climbing aids in most cases considerably improve the climbing properties of an unwaxed ski having a synthetic plastics running surface. If, however, the piste is very icy, the improvement in the climbing properties is slight. However, in most cases it is precisely under those conditions that good climbing properties are important. Moreover, for example, the positive scales generate unpleasant noises when going downhill. Finally, these known transverse profilings for skis brake too much in downhill running.

OBJECTS AND SUMMARY OF THE INVENTION

It is an object of the invention to provide a ski of the type described initially, which has very good sliding properties but is nevertheless distinguished by a good hold and hence push-off for the ski tourer when climbing, not only in dry or wet snow but also on icy and hard snow, such as cannot be achieved with the known mechanical aids to climbing.

It is another object of the invention to provide a ski the design of which, although being, above all, advantageous for use as a cross-country ski, also has advantages for use as an alpine ski.

These objects are achieved, according to the invention, in a ski of the initially described type which is improved by having a transverse profiling formed at least partially by fine rifling or grooves which run transversely to the longitudinal direction of the ski, the said grooves being cut into the material, i.e. produced by chip-removing treatment.

An excellent hold in climbing, such as was hitherto attainable only with skis which had been waxed to the optimum, is achieved by means of these cut transverse grooves. The sliding properties are equally good or better than those of the hitherto known skis which have as climbing aids a transverse profiling of the running surface or strips of skin attached thereto.

The ski according to the invention is, therefore, advantageous when used as an alpine ski, that is to say a ski for downhill running, whenever the skier is not intent on high speed but on being able, when necessary, to cope with little effort with not excessively steep gradients, such as is the case, for example, when ski touring in the mountains, in particular in the high mountains. Also, for example, beginners must always reascend the nursery slope. Finally, it is frequently convenient for beginners and older skiers if the ski does not run too fast when going downhill.

Accordingly, when devised as an alpine ski, the ski according to the invention preferably is a short ski or a shortened normal ski.

The transverse grooves in the ski according to the invention extend over only part of the width of the ski or, as is preferred, over the entire width of the ski. If the ski according to the invention has a tracking groove, this is normally not rifled transversely. The same applies to steel edges if these are present. Advantageously, the synthetic plastics bottom layer of the ski is kept relatively thick so that the transverse grooves, after they are worn off, can be brought back to the prior state of quality, for example by renewed grinding over.

The transverse grooves or "striations" are preferably of a type such as can be obtained by grinding with a sharp-grained grinding material, such as, for example, corundum. Such a material imparts to the finished synthetic plastics surface a partially fuzzy or finely scaled character, whereby this surface is given a very high friction coefficient relative to snow, when the ski is in resting position. This high friction coefficient prevents sliding back when the ski is loaded in the manner occurring during climbing. Skis having a smooth running surface, or those having a running surface which, as a climbing aid, is profiled in the middle region, can readily be produced according to the invention by moving a correspondingly rough grinding paper transversely across the ski with the aid of a grinding block. The skier himself is thus able with little effort to impart again, even to worn-down skis according to the invention, the desired climbing properties. A particularly favorable result is obtained when an abrasive material is used which has elongated abrasive grains protruding from the surface of the abrasive material, all in the same direction, at an acute angle of, for example, 60°, and when this material is moved across the running surface of the ski in such a way that the grains are inclined towards the tip of the ski, that is to say, the tip of each abrasive grain is always nearer to the tip of the ski than is the foot of the grain by which it adheres to the grinding body.

It is not necessary to produce the transverse striations in the ski according to the invention by means of a grinding process. For example, they can also be applied with the aid of appropriate, very finely toothed tools, such as, for example, a sufficiently fine rasping file. Grinding is, however, preferred since this results in a climbing aid of particularly high quality.

Another possibility for producing the transverse grooves or striations is to cut these in by means of a knife having a large wedge angle, for example 15°. In this case, the knife is pressed into the synthetic plastics material like the cutting edge of a chisel, so that the plastics material is displaced and beadings like the rim of a crater are produced at the edges of the incised groove. In order to improve the sliding properties of the ski, the knife is not pressed into the running surface vertically but in such a way that the bisecting line of the wedge angle of the knife forms an acute angle of, for example, 15° to 30°, preferably 20°, with the surface of that portion of the ski located between the incision being made and the rear end of the ski.

When a rasp is used, the teeth thereof should advantageously not be symmetrical but should have a steeper flank which in use faces the tip of the ski, and a less steep flank which in use faces the rear end of the ski.

The rifling or grooves can also be sawn by means of sufficiently fine saws, in which case the angle between the saw blade and the portion of the ski surface between the cutting point and the rear end of the ski should again be acute. For example, the angle can be 15° to 45°. Advantageously, the saw blade has cutting faces which run approximately perpendicular to the plane of the saw blade.

The grooves can also be milled in by means of a sufficiently fine miller-cutter. Appropriately, the teeth thereof then have a saw-tooth profile which is steeper on one side than on the other, and during milling, the flanks, which face the tip of the ski, of the teeth of the miller-cutter should be the steeper ones.

The distance of the transverse grooves from one another should preferably be as small as possible. It is best when the transverse grooves are adjacent to one another without a spacing ridge face therebetween; this type of rifling or grooving is produced by grinding, for example, by means of a circulating grinding belt or a rotary grinding wheel.

The depth of the transverse grooves, that is to say the distance between the remaining ridges and the bottom of the grooves, is also important in a ski according to the invention. This distance advantageously is between 0.02 and 0.4 mm, and better between 0.05 and 0.2 mm. Transverse grooves of a depth of 0.08 to 0.13 mm, which were produced by means of a circulating grinding belt with a grain size of the abrasive material of 40 to 24 (DIN 69,100) in a polyethylene, conventionally used for running surfaces of skis, under a moderate pressure, have proved very suitable. An excessive depth of the transverse grooves, for example of more than 0.5 mm, is likewise disadvantageous since it not only increases the frictional resistance in the middle region of the ski to an undesirable degree, but, furthermore, also weakens the synthetic plastics running surface of the ski in an undesirable manner and the latter wears too quickly.

Advantageously, the depth of the grooves under the region of the binding is about 0.08 to 0.13 mm, whilst it is less, that is to say for example 0.04 to 0.08 mm, in the regions of the transverse profiling which are in front of and/or behind the binding.

While the running surfaces of the front and rear parts of the ski are made as smooth as possible, the variations of the groove depths or of the fineness of the grooves in the middle region of the ski between the front and rear parts, which middle region extends underneath the binding and is essential when sliding the ski forward, impart to the ski especially improved adhesion to the snow, when standing, while maintaining, at the same time, good sliding properties when the ski is in motion.

A construction is preferred wherein the depth of the tranverse grooves starts at zero in the surface at the front end of the rifled middle region, and steadily increases up to the part of this region underneath the binding, where it remains constant over the length of the binding and then steadily decreases again to zero at the rear end of the middle region. The region which has transverse grooves advantageously amounts to about one half to three fifths of the entire length of the ski.

The protection against sliding backward is greatest if the transverse grooves run at right angle to the longitudinal direction of the ski.

The width of the transverse grooves can, for example, amount to 0.5 to 3 times the depths of the striations. A particularly advantageous combination of low frictional resistance and high adhesion when standing is achieved if the transversely rifled region is lightly stroked, from the tip of the ski towards the rear, with a very fine abrasive material under a slight pressure, for example with the abrasive material marketed by Minnesota Mining and Manufacturing Company under the name "Scotch Brite". In this way, the ridges formed between the grooves are flattened on their flank pointing towards the tip of the ski, while microfuzz and microscales, produced on the crest of the said ridge by chip-removing treatment, are tilted towards the rear end of the ski, whereby the sliding property of the ski is improved.

A transversely ground region which has been aftertreated in this way not only has the advantage that the running-in distance until the ski has its optimum sliding properties amounts to only about five to ten kilometers. Thereafter, it is also improved with respect to the sliding properties of the ski, in particular on a cross-country track of compacted, cold, crystalline snow.

It will be understood that a longitudinal polishing which is superimposed on the transverse rifling should only have a slight extent so that the longitudinal ground grooves in this region become barely visible and, in principle, merely tilt towards the rear, and flatten, the upper edges of the fine transverse ribs extending between the transverse grooves. Instead of the longitudinal polish from the front to the rear, a treatment with a polishing tool, such as, for example, a steel brush or a hard felt disk, from the front to the rear is also possible. This likewise facilitates sliding forward and makes sliding backward more difficult.

When the rifling, running transversely, is arranged in a herringbone pattern, this has the advantage that the longitudinal tracking effect of the tracking groove in the running surface of the ski is enhanced. The herringbone pattern preferably is of a type in which the grooves point towards the tip of the ski in the manner of an arrowhead.

The ground rifling, running transversely to the ski can also be formed by two systems of ground grooves, which cross one another and run diagonally, preferably both at the same but mirror-inverted angle to the longitudinal direction of the ski, the angle amounting to, preferably, 45°. With an arrangement of this type, care must of course be taken that one system does not predominate over the other.

In order to overcome this difficulty of uniform application, the two systems can also be applied by means of cylindrical grinding wheels which rotate in planes extending in the longitudinal direction of the ground riflings, and the peripheral surfaces of which are passed in this direction over the running surface of the ski. By holding grinding wheels at a slight inclination in such a way that their frontal area facing the front end of the ski is slightly tilted towards the running surface to be ground, whilst the opposite frontal area of the grinding wheel, pointing towards the rear end of the ski, is slightly turned away from the running surface of the ski, a field of mutually adjacent lozenges can be produced, each of which points in the longitudinal direction of the ski with one of its diagonals thus affording a herring-bone-type arrangement of the ground grooves. Due to the unevenness produced by the slightly oblique position of the grinding wheel, this arrangement is distinguished by a particularly high resistance to sliding backwards since, in this case, the effect of a known arrangement of macroscales is combined with that of the micro-grooves in the ski according to the invention. The ground grooves can also run along a circular arc. For example, this can be achieved by grinding with a cup wheel in a slightly oblique position.

The arrangement of transverse grooves in the ski according to the invention can also be superimposed upon any other arrangement of macroscales, known per se. Thus, for example, a pre-embossed positive scale arrangement, that is to say an arrangement in which the scales approximately have the character of roof tiles, can be reworked correspondingly. It is also possible, in the case of a negative scale arrangement in which scale-type recesses are present in the otherwise smooth running surface of the ski, to provide at least certain parts of the smooth ski surface with transverse grooving.

BRIEF DESCRIPTION OF THE DRAWINGS

Various preferred embodiments of the invention shall now be explained in more detail with reference to the accompanying drawings in which.

It should be noted especially that all drawings show only diagrammatic representations which are not to scale.

DETAILED DESCRIPTION OF THE EMBODIMENTS

Figure 1:
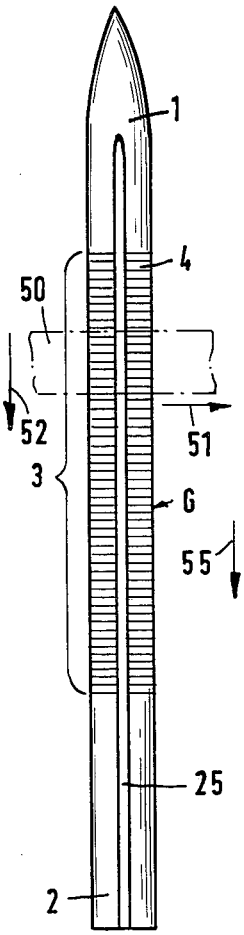
FIG. 1 shows in plan view the underside, bearing the running surface, of the ski according to the invention, with transverse grooves extending in the said surface at right angle to a track groove along the longitudinal axis of the ski.

The cross-country ski shown in FIG. 1 has a polyethylene running surface 2 which is customary for skis and is smoothed by fine longitudinal polishing in the customary manner in the front region 1 and rear region 2. Across the middle region 3 of this running surface, a group 4 of relatively evenly spaced, coarse grooves is ground into the underside of the ski and extends at right angle to a longitudinal track groove 25 of the ski, with a groove depth on the average amounting to about 0.1 mm. In a ski having a length of 2 meters, the rifled region 3 extends from the center of gravity G of the ski by 400 mm towards the front and by 400 mm towards the rear end of the ski. Thus, the rifled region 3 covers somewhat less than half the length of the ski.

This embodiment illustrates the simplest manner of carrying out the invention in practice. For example, the transverse rifling can be ground in by means of a grinding belt 50 which is conventional in the ski industry for longitudinal grinding but carries a coarse abrasive with, for example, a grain size of 30 (according to DIN 69,100) and which is passed, e.g. at a speed of 5 meters per second across the running surface 2 in the direction of the arrow 51, whilst being pressed on to the ski with a pressure of 10 to 30 grams per square centimeter. Since, usually, the belt is narrower than the longitudinal dimension of the region 3, the belt 50, which has, for example, a width of 15 cm, is advanced in the direction of the arrow 52 at, for example, a speed of 10 to 15 cm per second, or the ski is advanced in the opposite direction. An advance of the belt 50 in the opposite direction is less advantageous. The grinding can also be carried out, for example manually, using a correspondingly coarse abrasive paper bearing a layer of corundum or another equivalent abrasive, with the aid of a grinding block which effects a uniform contact pressure. Both grinding by hand and grinding by machine using the belt 50 are advantageously carried out dry.

In the embodiment shown in FIG. 1, the transverse ground grooves 4 are uniformly wide and uniformly spaced from one another and thus evenly distributed over the entire middle region 3.

Figures 2, 2A:
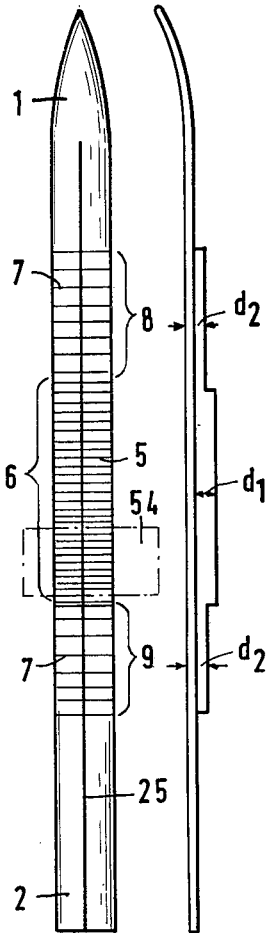
FIG. 2 shows a ski similar to that according to FIG. 1, but in which the ground grooves are more deeply ground and thus larger in a middle region under the ski binding, while they are narrower in adjacent zones toward the ends of that rifled region.
FIG. 2A shows diagrammatically the variation of the depths of the ground grooves in the embodiment according to FIG. 2, over the rifled region of the ski.

The embodiment of a ski shown in FIG. 2 differs from the embodiment shown in FIG. 1 by a different nature and arrangement of the transverse ground grooves, in that relatively deep ground grooves 5 are provided in the region 6 of the underside of the ski beneath the ski binding, whilst less deep ground grooves 7 are applied in the intermediate region 8 in front of the binding and in the intermediate region 9 behind the binding. Here again, the ground rifling 5,7 extends at a right angle to the longitudinal axis of the ski.

The deep ground grooves 5 have preferably an average depth of 0.1 mm. When the ski has a length of 180 cm, the region 6 will extend from the center of gravity thereof by 21 cm towards the front end 1 and by 34 cm towards the rear end 2 of the ski. The grooves 5 are ground in by using a grinding body of grain size 24

(DIN 69,100). The regions 8 and 9, in which the flat ground grooves 7 are cut, extend toward the front and the rear, respectively, each over a length of 16 cm. The groove average depth is about 0.05 mm, i.e. half that of the deeper grooves 5. The grooves 7 are ground in using a grinding body of grain size 40 (according to DIN 69,100).

As a final treatment, the entire transversely ground region 8,6,9 is very lightly machine-reground, using a "Scotch-Brite" grinding belt 54 indicated in phantom lines, which is moved in the direction indicated by the arrow 55 from the tip end 1 of the ski towards the rear end 2 thereof, in order to improve the sliding properties of this region further. During this light regrinding in the longitudinal direction of the ski, only a relatively small amount of material, such as protruding microfuzz and sharp crests in the zone of transverse rifling, must be abraded. It is sufficient to regrind this region 8,6,9 lightly two to three times with "Scotch-Brite".

This light regrinding or similar reworking from the front towards the rear of the ski also substantially improves the sliding properties of the other embodiments shown in the drawings, although this is only described in the case of the embodiment of FIG. 2. In lieu of "Scotch-Brite", another abrasive material, such as, for example, fine abrasive paper of, for example, a grain size of 240 (according to DIN 69,100) can be used. However, an abrasive material of the "Scotch-Brite" type is preferred. Similar effects can also be achieved by brushing with a fine steel wire brush or by polishing with a felt disk, always from the front towards the rear end of the ski.

The curve delineating the depths of the transverse grooves 5 and 7 in the respective regions 6,7 and 8 is shown schematically in FIG. 2A. Grooves 5 have the depth $d_1$, grooves 7 the depth $d_2$.

Figures 3, 3A:
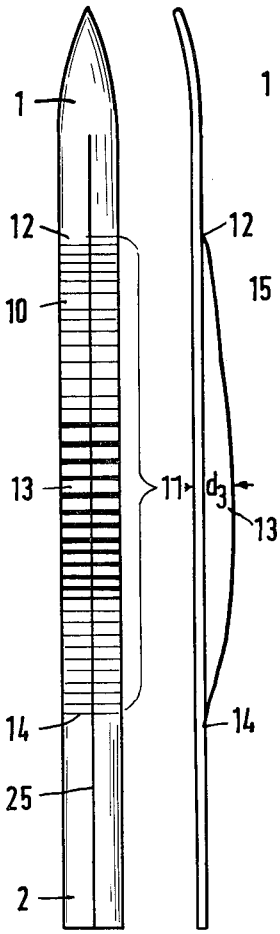
FIG. 3 shows, in a similar representation as in FIG. 2, a third arrangement of ground grooves extending at right angle to the longitudinal axis of the ski.
FIG. 3A shows diagrammatically the variation of the depths of the ground grooves in the embodiment according to FIG. 3, over the rifled region of the ski.

The embodiment of a ski shown in FIG. 3 differs from the embodiment of FIG. 2 essentially in that the depth of the transverse ground grooves does not change stepwise, depending on the three regions 8,6 or 9 to which the grooves pertain, but that, rather, the ground grooves 10 are distributed over the entire rifled zone 11 from a front starting limit 12, where they begin at a hardly noticeable small depth, these grooves having a slowly increasing depth up to about the mid-way zone 13 between the binding and the heel plate on the ski and then steadily decreasing in depth again to almost zero depth at the rear limit 14 of the system of transversely cut ground grooves 10.

The curve defined by the depths of the transverse grooves 10 in relation to their location in rifled zone 11 as shown graphically in FIG. 3A illustrates the variation of the depth $d_3$ of the ground grooves 10 over the length of region 11 of the ski.

In FIGS. 2 and 3, the central tracking groove 25 is only indicated by a single line.

Figure 4:
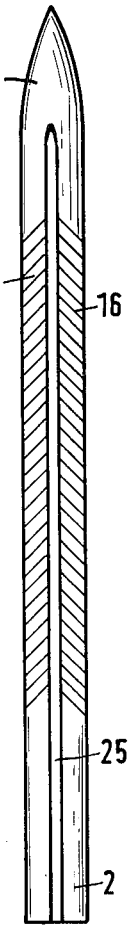
FIG. 4 shows, in a similar view as in FIGS. 1 to 3, a further embodiment of a ski according to the invention having a different arrangement of ground grooves.

The embodiment of a ski according to the invention shown in FIG. 4 differs from the skis shown in FIGS. 1, 2 and 3 in that the ground grooves 15 and 16 in this ski extend in a type of herringbone or arrowhead-type system and that they are mirror-symmetrical relative to the longitudinal tracking groove 17. Groove 17 can also be entirely dispensed with in this embodiment if the angle between the ground grooves and the longitudinal axis of the ski is made sufficiently small. It will be understood that the grooves 15 and 16 of this system can also have stepwise or varying depths in a similar way as in the skis of FIGS. 2 and 3.

Figure 5:
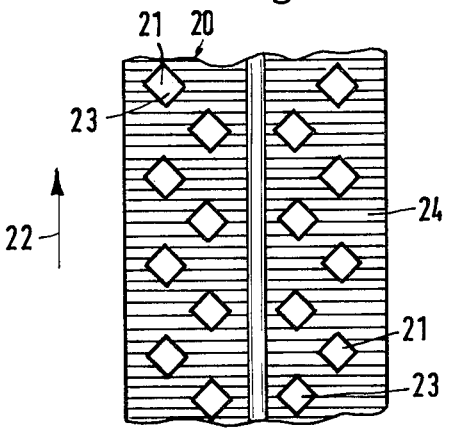
FIG. 5 shows, viewed from below and on a substantially larger scale compared with FIGS. 1 to 5, the underside of a cross-country ski having, in another embodiment of the invention, a negative scale profiling combined with the arrangement of transverse ground grooves.

The embodiment shown in FIG. 5 in part and viewed from below, is provided, in its running surface 20, with square recesses or "negative scales" 21 which are diagonally positioned relative to the longitudinal axis of the ski. These recesses have, at their end facing away from the tip 1 of the ski toward which the arrow 22 points, a depth of zero, while their depth steadily increases towards the rear end 23. These recesses 21 have a distance from each other which is approximately equal to the width of the individual recess. The running surface of this ski is also formed in a conventional manner from an appropriate synthetic plastics material, preferably polyethylene, and is otherwise plane. The plane areas of the running surface on this ski are rifled transversely by means of grooves 24 cut in the same region as in the skis shown in FIGS. 1, 2 and 3. Thus the effect of negative profiling by means of recesses 21 is combined in this embodiment with a system of ground grooves 24 in accordance with the invention. Also, in this embodiment a subsequent longitudinal grind with a "Scotch-Brite" belt is recommended.

Figure 6:
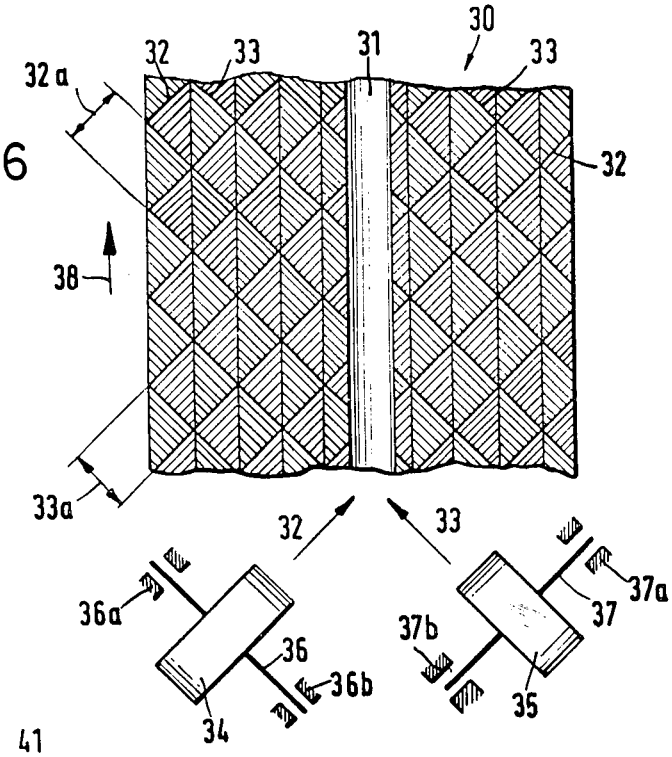
FIG. 6 shows, approximately in actual size, a region of another embodiment of a ski according to the invention, the running surface of which is provided with two groups of parallel ground grooves intersecting one another.

FIG. 6 shows a plan view of the longitudinally central part of the running surface 30 of yet another embodiment of a ski which surface 30 has, in its flat parts, i.e. on either side of the tracking groove 31, two systems of ground grooves 34 and 35 each of 1 cm width. Accordingly, the respective width of each of ground strips **32*a* and 33*a***, extending at an angle of 45° to the longitudinal axis of the ski, also equals 1 cm.

As can be seen from FIG. 6, the surface 30 carrying the ground grooves in this arrangement is sub-divided into a multitude of lozenges extending diagonally to the longitudinal axis of the ski. Each lozenge area has a herringbone-type arrangement of ground grooves 32 or 33, the tip of the herringbone-type arrangement pointing towards the tip of the ski as indicated by the arrow 38. This arrangement can be obtained by tilting, during motion, of the grinding wheels 34 and 35 rotating about their shafts 36 and 37 in the direction of the arrows 31 and 32 respectively, the bearings **36*a* and 37*a* of the ends of these shafts 36 and 37 pointing toward the tip of the ski (arrow 38) slightly downwardly, that is to say towards the running surface 30 of the ski, whilst bearings 36*b* and 37*b* at the other ends of the shafts 34*a* are slightly tilted away from the surface 30**.

Figure 7:
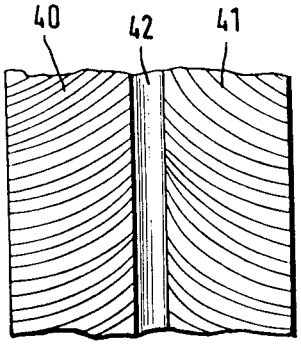
FIG. 7 shows, likewise approximately in actual size, a part of the underside of a ski in another embodiment according to the invention, wherein the ground grooves describe circular arcs.

Finally, a further arrangement of ground grooves 40 and 41 is shown in FIG. 7, in which arrangement the ground grooves run mirror-symmetrically with respect to the tracking groove 42 and are in the shape of circular arcs. A grind of this type can be accomplished with relative ease with the aid of a cup wheel (not shown) which is set slightly obliquely.

In the embodiment of FIG. 7, the running surface of the ski can be reground twice so that the two different systems of ground grooves 40 and 41 are obtained. However, it is also possible to produce only one system of ground grooves when displacing the shaft of the cup wheel during grinding along the central tracking groove 42 of the ski. In this case, the center of the curvature of each ground groove should lie between the rear end of the ski and the ground groove, whilst in the embodiment illustrated in FIG. 7 the respective center of curvature of each ground groove 40 and 41 is advantageously located slightly outside the ski and between the tip of the ski and the respective ground groove.

Figure 8:
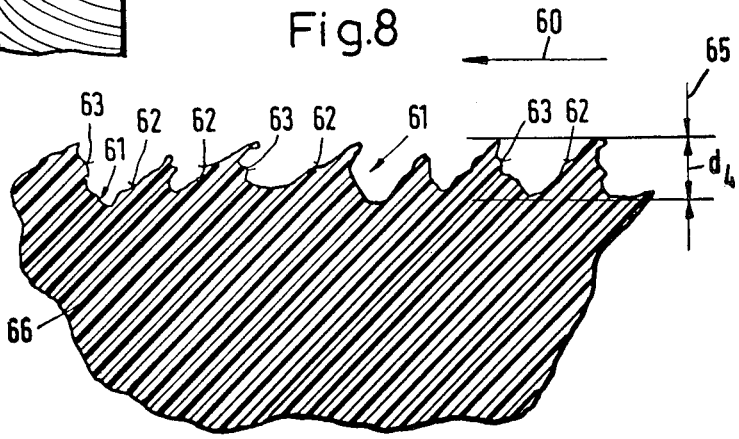
FIG. 8 shows, enlarged approximately one hundred times, the region indicated by VIII—VIII in FIG. 3.

The structure of the transverse microgrooves in the skis according to the invention can be better seen from FIG. 8. As shown therein, the arrow 60 points toward the tip of the ski. It is seen that the flanks 62 of the grooves 61, facing toward the tip of the ski, are at a flatter angle with the surface 65 than the flanks 63 facing toward the rear end of the ski. The average depth $d_4$ of the ground grooves is also indicated.

When using the ski according to the invention as a beginner's ski for alpine skiing, the shaping of the running surface of the ski according to the invention can be easily removed, after a sufficient state of beginner's training has been reached, by corresponding longitudinal polishing of the running surface.

In the case of a ski provided with steel edges, these are advantageously left free from transverse rifling.

The polyethylene of the running surface, which is bonded to the ski over the whole area of the ski underside in a conventional manner and is designated as 66 in FIG. 8, is preferably a polyethylene specially made for running surfaces of skis to be largely free from pores (pore content 3–5% by volume), such as supplied, for example, by Inter-Montana Sport A. Muller & Co., of Hergiswil, Switzerland, under the name "P-Tex 1,000" in the form of films. Known polyethylene coatings into which sliding waxes have already been incorporated during manufacture are also suitable. These coatings are particularly water-repellent and resistant to oxidation, and are also supplied by the same company.

It should also be mentioned that it is not absolutely necessary to produce the fine transverse grooves by chip-removing treatment, that is to say by grinding, rasping, planing, cutting, milling and the like, although this chip-removing treatment of the synthetic plastics material forming the running surface of the ski ensures a particularly good combination of sliding properties and a push-off aid for climbing. The fine transverse grooves can also be formed by chipless shaping, such as injection-molding or embossing or pressing, in which case, for example, a film which forms the running surface and consists of a suitable polyethylene is pressed or embossed in the desired region of its surface with the aid of a metal sheet which is rifled complementarily to the desired transverse grooves, whilst being heated up to the softening range of the material. The surface is then cooled again and roughened in the direction from the tip of the ski towards the end of the ski, for example by using "Scotch-Brite" or a sharp wire brush. This procedure represents a simpler manufacturing technology.

The invention further comprises a method of making a ski according to the invention having any of the above-described patterns of a rifling of transverse grooves, by any of the modes of operation described hereinbefore.

It will be understood that the invention is not restricted to the illustrative embodiments shown and that many modifications are possible within the scope of the claims.

I claim:

1. An improvement in a ski having a tip and a rear end, a middle region, a running surface and a profiling transverse to the longitudinal axis of the ski in at least one region of the underside of the ski intermediate said tip and said rear end, a rifling of grooves extending transversely to the longitudinal axis of said ski in said region of the underside of the ski and constituting at least part of said transverse profiling, portions of said ski underside adjacent said region and up to said tip, on the one hand, and up to said rear end, on the other hand, are smooth, said transverse grooves are cut into the material constituting the underside of said ski, said running surface constituted of synthetic plastics material, said rifling of grooves located in said middle region and said transverse grooves having partially fuzzy walls and edges resulting from rough chip removing treatment.

2. The improvement as described in claim 1, wherein said transverse grooves are coarsely ground-in grooves, said transverse grooves being adjacent to one another without a spacing ridge face therebetween.

3. The improvement as described in claim 1, wherein said transverse grooves have a depth ranging from 0.02 to 0.4 mm.

4. The improvement as described in claim 3, wherein the depth of said transverse grooves ranges from 0.05 to 0.2 mm.

5. The improvement as described in claim 1, wherein the rifling of grooves extends over said middle region on the opposite side of which the ski binding is located, over an intermediate region adjacent said middle region and toward the tip of the ski, and over an intermediate region adjacent said middle region and toward the rear end of the ski, and wherein the transverse grooves in said middle region are of greater depth than the transverse grooves in said intermediate regions.

6. The improvement as described in claim 5, wherein the depth of said transverse grooves in said middle region ranges from 0.08 to 0.13 mm.

7. The improvement as described in claim 5, wherein the depth of said grooves decreases from a maximum depth approximately in the center of said middle region toward zero at the limits where said intermediate regions merge with said smooth zones at the tip and rear end of the ski.

8. The improvement as described in claim 2, wherein said transverse grooves extend at a right angle to the longitudinal axis of the ski.

9. The improvement as described in claim 2, wherein the transverse grooves extend in arrow-head arrangement with the tips of the arrows pointing toward the tip of the ski.

10. The improvement as described in claim 2, wherein the transverse grooves extend along circular arcs.

11. The improvement as described in claim 2, wherein the transverse grooves are arranged in two systems, the grooves of each system intersecting those of the other system and extending diagonally to the longitudinal axis of the ski.

12. The improvement as described in claim 2, wherein the flank of each transverse groove facing toward the rear end of the ski is more steeply inclined relative to the bottom surface of the ski than the other flank of the groove which faces toward the tip of the ski.

13. The improvement as described in claim 2, wherein a rifling of fine longitudinally extending grooves is superimposed over the transverse grooves, the latter being of greater depth than the former.

14. A method of producing a ski having the improvement defined in claim 2, comprising the step of grinding said transverse grooves into the underside of the ski by means of a grinding body to which the grinding grains producing said grooves are connected at least in the beginning of the grinding treatment.

15. A method as described in claim 14, wherein the grains connected to the grinding body are of a size ranging from 20 to 80 (according to DIN 69,100).

16. A method as described in claim 14, wherein the grains connected to the grinding body are of a size ranging from 24 to 40 (according to DIN 69,100).

17. A method as described in claim 14, further comprising, after said grinding step, the step of polishing the rifled region of the ski from the tip toward the rear end of the ski, thereby producing in the transverse grooves flanks facing toward the ski tip which are less steeply inclined relative to the underside of the ski than are the opposite flanks of the grooves which flanks are inclined toward the rear end of the ski.

18. A method as described in claim 17, wherein said polishing is carried out with the aid of a fine-polishing agent.

19. A method of producing a ski having the improvement defined in claim 1, comprising the step of forming the underside of the ski with a rifling of transverse grooves therein, integrally and simultaneously with said underside, and then roughening the running surface from the tip toward the rear end of the ski.

20. A method as described in claim 19, wherein said forming is carried out by injection-molding.

21. A method as described in claim 19, wherein said forming is carried out by pressing.

22. A method as described in claim 19, wherein said forming is carried out by embossing.

* * * * *